United States Patent [19]

Loomis et al.

[11] 4,306,714

[45] Dec. 22, 1981

[54] ISO-ENERGETIC ANKLE EXERCISER

[76] Inventors: Joseph L. Loomis, R.D. 1, Box 81 F, Pennsylvania Furnace, Pa. 16865; Daniel P. Riley, 805 Brookside Dr., Boalsburg, Pa. 16827; Walter J. Hochberg, 702 Windsor Ct., State College, Pa. 16801

[21] Appl. No.: 137,853

[22] Filed: Apr. 7, 1980

[51] Int. Cl.[3] ..... A63B 23/04

[52] U.S. Cl. ..... 272/96; 272/126

[58] Field of Search ..... 272/126, 96, 97, 130, 272/137, 132, 125, 145; 128/25 B

[56] References Cited

U.S. PATENT DOCUMENTS

| | | | |
|---|---|---|---|
| 2,216,764 | 10/1940 | Clark | 128/25 B |
| 3,547,434 | 12/1970 | Ossenkop | 272/97 |
| 4,159,111 | 6/1979 | Lowth | 272/132 |

*Primary Examiner*—Richard J. Johnson

*Attorney, Agent, or Firm*—Thomas E. Sterling

[57] ABSTRACT

This is an ankle and/or wrist exercising device capable of simultaneous rotational movement about any single axis and/or any combination of two or three axes with the resistance to movement provided by the opposite limb, ergometer or a second person and with the motion being synchronized for each foot or hand relative to the opposite foot or hand.

The device is comprised of two U-shaped yokes rotatably mounted upon a base, adapted to rotate about a Y axis and rotatably coupled to one another. There are two U-shaped brackets rotatably coupled to each of said U-shaped yokes, adapted to rotate about a Z axis perpendicular to said Y axis and rotatably coupled to one another. Two U-shaped gimbals are integrally coupled to each of said U-shaped yokes. Two stirrups are rotatably mounted upon each of said U-shaped gimbals and adapted to rotate about an X axis. The X axis is perpendicular to the Y axis and the Z axis. Each of said stirrups is coupled to the other by a beam adapted to transmit X axis motion.

8 Claims, 7 Drawing Figures

ISO-ENERGETIC ANKLE EXERCISER

This invention relates to an exercise device and in particular to an exercise device for the hands or feet in which the user supplies the force and motion by one hand or foot which will be countered by a resistance and similar motion of the other hand or foot.

The inventors know of no prior art anticipating this invention. The inventors are not withholding known prior art which they consider anticipates this invention.

This instrument rotates in three axes and is capable of being restrained from movement in each axis independently. The possible movement is therefore about any one of the three axes with the two other axes locked, any combination of two axes with the remaining axis locked, or rotation about all three axes with no rotational locks in place.

The rotational movement about any given axis of one foot is duplicated with an equal rotation about the same axis by the other foot. Rotation in three dimensions about either the X, Y or Z axis or any combination thereof is possible with this device.

Rotation about the Z axis provides flexibility and strength training of the appropriate muscle group. Rotation about the X axis provides flexibility and strength of the Dorsi-Flexor and extensor muscles of the foot and ankle. Rotation about the Y axis provides flexibility and strength of the lateral (inversion and eversion) muscle groups. Each foot is secured to an individual platform which assures that the desired foot movement and muscle involvement is obtained. A device is needed to improve the range of motion of the foot and ankle while being simultaneously rotated and restrained by self-induced force. There is no instrument now available to perform the function of the present invention. The type and range of motion and the force applied are fully under the control of the person exercising.

This invention is a multiple axis unit designed to exercise the lower leg, ankle and foot via reciprocal resistance, controlled by the individual using the unit. The unit allows rotation of the foot about three axes to enhance both training and rehabilitation. This exercise unit will improve flexibility and range of motion in the lower leg, ankle and foot. In addition, the general strength of the muscles of the lower leg which support the ankle will be increased through isolated contralateral resistance movements.

The unit can be used by young and old alike and is easily adaptable to any weight training program designed for active people and athletes as well as persons needing adaptive or rehabilitive training. It can be incorporated into an existing program as an additional exercise tool to provide adequate strength and flexibility for the prevention of lower leg and ankle injuries associated with sports or leisure activities. It can also be readily adapted to hand operation for similar assistance of hand and wrist applications. The ankle exerciser will provide the field of sports medicine, physical therapists, coaches and athletic trainers with a simple, easy-to-use exercise unit to help speed recovery time and rehabilitate lower leg and ankle injuries.

The independent, three axes rotational interconnection of the two platforms provides two principle advantages: (a) each movement by one foot is matched by an equal movement of the other foot, and (b) any force used to impart the movement is matched by an equal and opposite force exerted by the other foot attempting to resist the movement.

Many methods are available for obtaining three axes rotational movement and the method chosen and herein described in not exclusive to this patent. However, the application of this motion to the enhancement of flexibility and strength training by common rotation and mutual resistance of the opposite foot or hand is a unique contribution.

An object of this invention is to provide an exercise device for the feet and lower legs which will allow rotation about all three axes.

Another object of this invention is to provide an exercise device for the lower leg, ankle and foot utilizing reciprocal resistance controlled by the individual using the device.

Still another object of this invention is to provide an exercise device that may be used for the lower leg, ankle and foot and also the lower arm, wrist and hand.

Yet another object of this invention is to provide an exercise device which will operate selectively on one or more of three axes of motion.

Still another object of this invention is to provide an exercise device by which each movement of one foot is matched by an equal movement of the other foot and the force imparted by this movement is matched by an equal and opposite force exerted by the other foot.

These and other objects of this invention may be seen by referring to the below specification and claims taken in conjunction with the accompanying drawings.

Figure 2A:
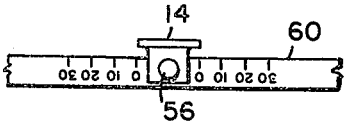
FIG. 2 is a front view of the invention taken along lines 2—2 of FIG. 1.
Figure 2:
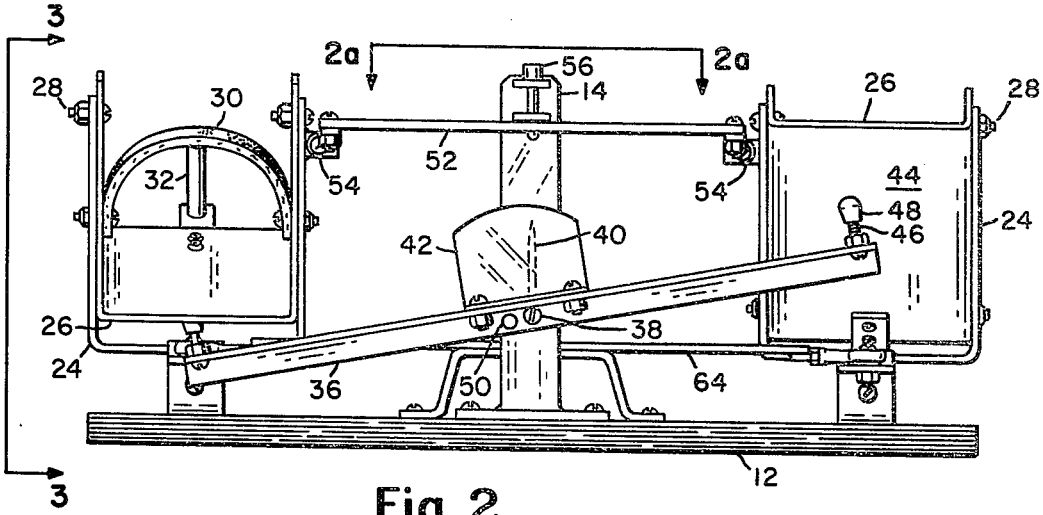

FIG. 2*a* is a top view of the Y axis indicator of the device taken along lines 2*a*—2*a* of FIG. 2.

Figure 3:
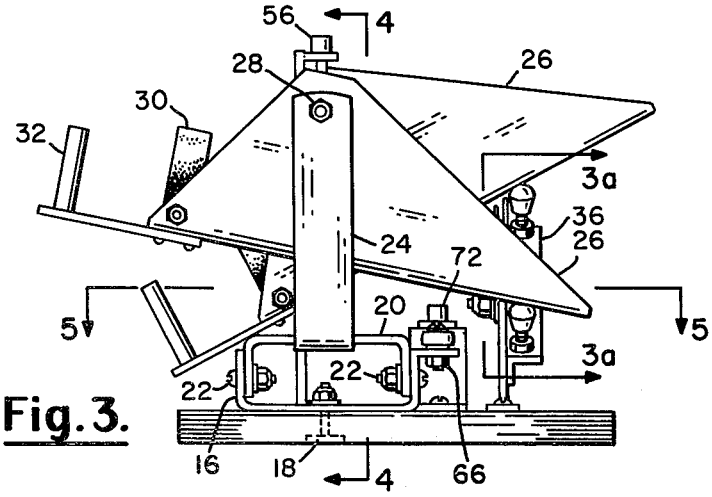

FIG. 3 is a side view of the device taken along lines 3—3 of FIG. 2.

Figure 3A:
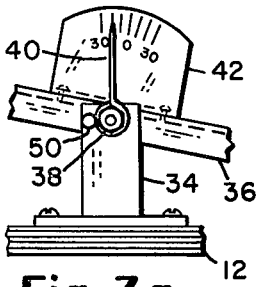

FIG. 3*a* is a view of the X axis indicator of the device taken along lines 3*a*—3*a* of FIG. 3.

Figure 4:
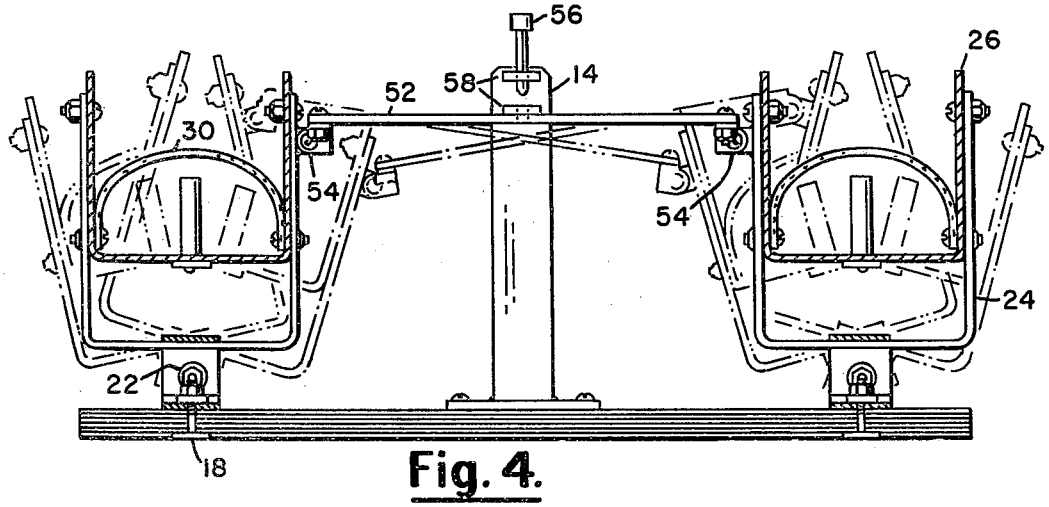

FIG. 4 is a schematic front view of the device partially in phantom view showing only the elements of the device which rotate about the Z axis.

Figure 5:
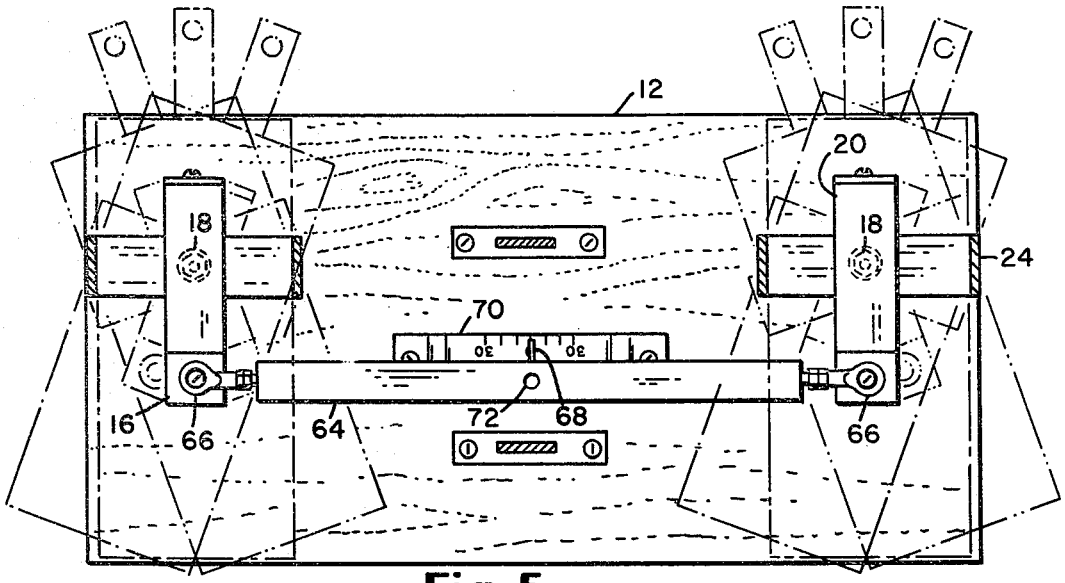

FIG. 5 is a schematic top view of the device partially in phantom view showing only the elements of the device which rotate about the Y axis.

Figure 1:
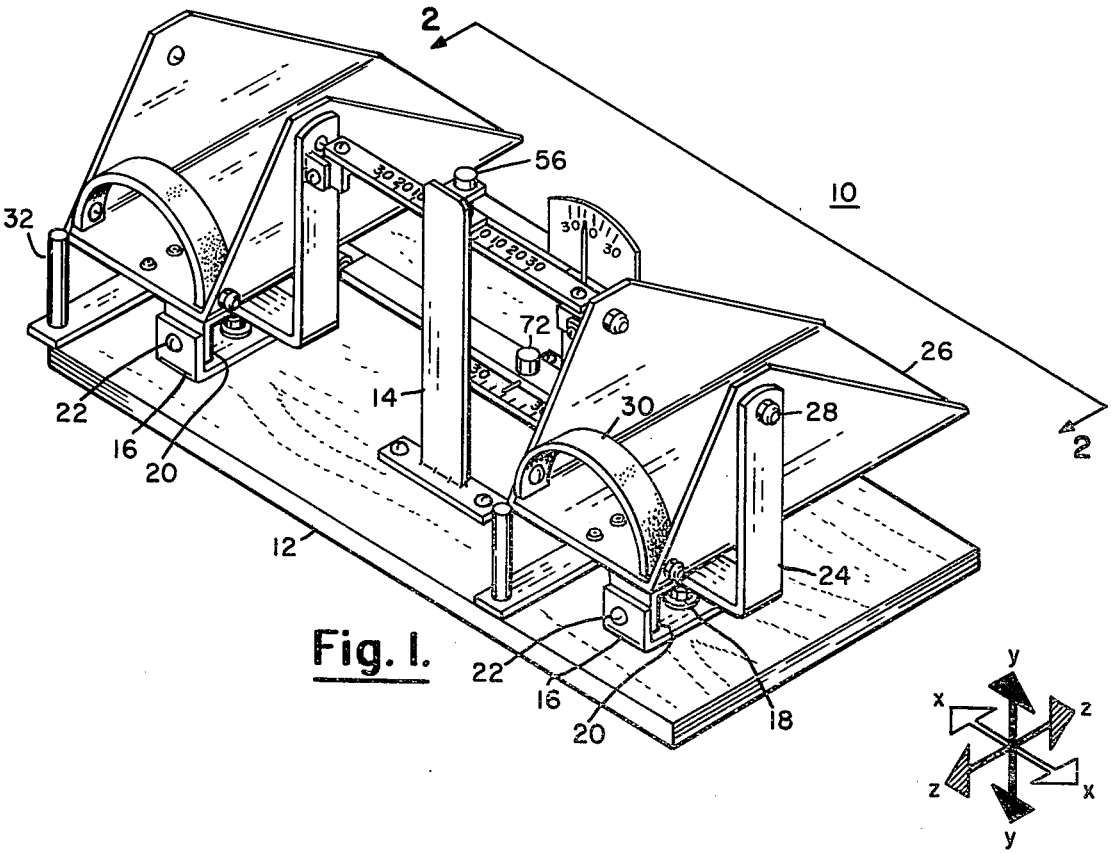
FIG. 1 is a three dimensional perspective view of the invention. The X, Y and Z axes of the invention are indicated by the side arrows.

Referring to the drawings and in particular to FIG. 1, 10 represents the exercise device mounted upon a board 12. A central pillar 14 is positioned by screws penetrating the board. On either side of the pillar 14 are positioned identical U-shaped yokes 16 each of which is rotatable about a Y axis pivot bolt 18 extending through board 12. A U-shaped bracket 20 is rotatably positioned upon each U-shaped yoke 16 which extends through U-shaped brackets 20 and U-shaped yokes 16 by means of Z axis pivot bolts 22. Two pivot bolts 22 are used on each yoke 16. It should be noted that the entire assembly upon each of the two U-shaped yokes 16 is identical to the other, hence a description of one assembly may be considered applicable to the other. Two U-shaped upright gimbals 24 are welded to U-shaped brackets 20. Two U-shaped stirrups 26 are rotatably attached to gimbals 24 by means of X axis pivot bolts 28 which pass through gimbals 24 and stirrups 26. Boot holder straps 30 extend across stirrups 26 and are adapted to hold shoes positioned within the stirrups 26. L-shaped hand grips 32 are attached to the forward portion of the stirrups 26 and extend outwardly thereform. This hand grip 32 permits each stirrup 26 to be easily moved by grasping the hand grip 32.

An X axis fulcrum 34, as shown in FIG. 3*a*, is positioned on board 12 forward of central pillar 14 and screwed to board 12. An X axis beam 36 is rotatably positioned on fulcrum 34 by means of beam bolt 38 which goes through both fulcrum 34 and X axis beam 36. An X axis indicator needle 40 is vertically positioned by beam pivot bolt 38 and the X axis indicator 42 is attached to and rotates with the central portion of beam 36 by means of bolts (See FIG. 3*a*). Thus the tilting of the bean 36 will cause the indicator needle 40 to point to marks on the indicator 42 indicating degrees of tilt. Each end of beam 36 has an upright stirrup contactor 44 thereon. Stirrup contactor 44 is comprised of an upright screw bolt 46 on the end of which is positioned a plastic button 48 which bears against the bottom of stirrups 26. Thus the pressing of one stirrup 26 downward will cause beam 36 to rotate upon beam bolt 38 and to force the opposite stirrup 26 upward. An X axis locking pin 50 shown, extends through X axis fulcrum 34 and may be inserted into the X axis beam 36. When lock pin 50 is fully pushed in to the lock position, X axis beam 36 is locked in a horizontal position and will not move.

A Z axis tie rod 52 is rotatably connected at either end to the upper inner portions of gimbal 24 by means of tie rod pins 54. The rotation of gimbal 24 about Z axis pivot bolts 22 will cause tie rod 52 to rotate about tie rod pins 54 (See FIG. 4). A Z axis lock pin 56 extends through two horizontal flanges 58 of central pillar 14 and through Z axis tie rod 52. When lock pin 56 is thus positioned, Z axis tie rod 52 is held rigid and will not move. A Z axis indicator 60 is attached to the upper central portion of Z axis tie rod 52 and indicates the degree of tilt about the Z axis as the tie rod 52 moves (See FIG. 2*a*).

A U-shaped Y axis locking bracket 62 is positioned on board 12 between central pillar 14 and X axis fulcrum 34 and held in position by screws. A Y axis tie rod 64 is pivotally connected to the end portion of the U-shaped yokes 16 by means of Y axis tie rod bolts 66 (See FIG. 5). Rotation of yokes 16 about Y axis pivot bolts 18 will cause Y axis tie rod 64 to move horizontally about Y axis tie rod bolts 66. A Y axis indicator needle 68 is integrally attached to Y axis tie rod 64 at its mid portion. A Y axis indicator scale 70 is positioned upon the top of Y axis fulcrum 62. As the indicator needle 68 moves past the fixed scale the degree of Y axis motion is indicated. A Y axis lock pin 72 passes through Y axis tie rod 64 and Y axis fulcrum 62. When lock pin 72 is in position the Y axis motion of the device is locked and will not allow rotation about the Y axis.

Thus it may be seen that the exercise device is comprised of three separate systems each individually permitting rotation of the stirrups 26 about the X, Y and Z axes respectively. Removal of the X axis lock pin 50 will permit the stirrup 26 to rotate about the X axis. Likewise the removal of the Y axis lock pin 72 and the Z axis lock pin 56 will permit the stirrups 26 to rotate about the Y and Z axes respectively. The X, Y and Z axes indicators and needles permit the user to note the degree of rotation in each of these axes.

In operation when extension exercise is desired, an individual using the exerciser sits on a chair in front of the device with his heels against straps 30 and secures his feet to the stirrups 26. If he wishes an exercise with up and down motion of the toes (X axis), he removes X axis lock pin 50 and presses down on one of the stirrups 26 with one foot and resists the movement with the other foot. Thus, when the heel of the left stirrup is pressed down, as in FIG. 2, the bottom of the stirrup 26 presses against stirrup contactor 44 forcing the left side of X axis beam 36 downward and the right side upward. The stirrup contactor 44 on the right side presses upward against the right stirrup 26 forcing the heel of the stirrup 26 upward. Reversing the pressure, opposite results are produced.

Should the operator desire exercise of the flexior muscles, lifting of the toes, the exerciser should be turned so that the toes may be inserted under the straps 30. The locking pin 50 should be removed and motion accomplished by lifting the toes of one foot while resistance is provided by the opposite foot. Flexion exercise is thus achieved. The heels should remain firmly in contact with both stirrups 26. With maximal rotation achieved the degree may be noted on indicator 42. Reversing the action with the opposite foot provides the return travel and provides balanced exercise.

When the operator wishes a rotation about the Y axis, he removes Y axis lock pin 72. He then rotates one foot in the stirrup 26 causing the stirrup 26 to rotate about Y axis pivot bolt 18. Y axis tie rod 64 transmits this rotation through Y axis tie rod bolt 66 to the opposite stirrup. Movement of one foot may thus be resisted by the other foot.

When the operator wishes a lateral tilting motion (Z axis), he removes Z axis lock pin 56. This permits the stirrups 26 to rotate about Z axis pivot bolt 22. Z axis tie rod 52 of one stirrup will transmit the equivalent lateral motion to the opposite stirrup through Z axis tie rod pin 54.

Alternatively the resistance force to any movement of the feet may be supplied by a second person grasping the hand grips 32 and manually supplying the resistance or exercise motion. An ergometer may also be used.

More specifically the exercise may be carried out as indicated below.

I. Operation

A. Individual using this ankle exerciser must be sitting on a chair of appropriate height with knees flexed (bent) at 90°.

B. Feet are placed in foot stirrups 26 with heels pulled back in stirrups as far as possible.

C. Resistance is applied with opposite foot when performing the exercises.

II. Exercise Positions

A. Rotation (right or left) —Y Axis—

1. Feet in stirrups 26.
2. Pin 72 is removed.
3. Foot is rotated (turned right or left) while resistance to the motion is applied with the opposite foot.
4. Resistance should be enough to permit full range of motion through the movement, but difficult enough to be beneficial.
5. Range of motion is shown in both the right and left direction by the indicator 70.

B. Flexion-Extension (up and down) With Toes And Heels Pressing Down On Stirrups Exercising The Extension Muscles —X Axis—

1. Both feet in Stirrups 26, heels back in stirrups as far as possible.
2. Pin 50 is removed.

3. One foot is pushed down and resisted as the other foot comes up.
4. Resistance is applied by the opposite foot in the up and down motion.
5. Range of motion is shown by indicator 42.

C. Flexion-Extension (up and down) With Toes Lifting Up On Straps Exercising Flexior Muscles —X Axis—

1. Both feet in stirrups, toes under retaining straps 30.
2. Pin 50 is removed.
3. The toes of one foot are lifted up and resisted by toes of the other foot as they move down. The heels should remain in contact.
4. Resistance is applied by the opposite foot in the up and down motion.
5. Range of motion is shown by indicator 42.

D. Inversion-Eversion (lateral tilting) —Z Axis—

1. Both feet placed in stirrups 26, heels back as far as possible.
2. Pin 56 is removed.
3. Both feet are tilted to the side (laterally).
4. Resistance is applied with opposite foot during the motion.
5. Range of motion is shown by indicator 60.

We claim:

1. An exercise device adapted to actuation by the feet, comprising in combination:

a base board;

two U-shaped yokes rotatably mounted on said base board, adjacent to one another;

two U-shaped brackets each rotatably mounted upon said U-shaped yokes;

two U-shaped gimbals rotatably mounted upon a U-shaped bracket;

two stirrups each rotatably mounted upon a U-shaped gimbal;

two boot holders each mounted upon a stirrup and adapted to securely hold a foot thereon;

an X axis fulcrum integrally mounted upon said base board and positioned between said U-shaped yokes;

an X axis beam rotatably mounted upon said X axis fulcrum;

a lock pin extending through said X axis fulcrum and said X axis beam and adapted to prevent the rotation of said X axis beam.

stirrup contactor means integrally positioned on the end portions of X axis beam, each stirrup contactor means in contact with the bottom portion of said stirrup;

a Y axis fulcrum integrally connected to said base board and positioned between said U-shaped yokes;

a Y axis tie rod, the end portions of which are rotatably connected to said U-shaped yokes whereby Y axis motion of one of said U-shaped yokes is transmitted to the other of said U-shaped yokes;

a central pillar integrally connected to said base board and positioned between said U-shaped yokes;

a Z axis tie rod, the end portions of which are rotatably connected to each of said U-shaped gimbals, whereby Z axis rotation of one of said U-shaped gimbals is transmitted to the other of said U-shaped gimbals.

2. The combination as claimed in claim 1 having a Y axis lock pin extending through said Y axis tie rod and said Y axis fulcrum and adapted to prevent the motion of said Y axis tie rod.

3. The combination as claimed in claim 2 having a Z axis lock pin extending through said central pillar and through said Z axis tie rod adapted to prevent the motion of said Z axis tie rod.

4. The combination as claimed in claim 3 having indicator means upon said X axis fulcrum adapted to indicate the degree of tilt of said X axis fulcrum.

5. The combination as claimed in claim 4 having indicator means upon said Y axis fulcrum for indicating the degree of Y axis rotation of said stirrups.

6. The combination as claimed in claim 5 having indicator means upon said central pillar adapted to indicate the degree of Z axis rotation of said stirrups.

7. The combination as claimed in claim 6 having a hand grip attached to each of said stirrups adapted to rotate said stirrups about any axes.

8. The combination as claimed in claim 7 providing a device useful in exercise and rehabilitation to extend both range of motion and to increase strength of the involved muscles.

* * * * *